US012631042B2

(12) United States Patent
Wu

(10) Patent No.: US 12,631,042 B2
(45) Date of Patent: May 19, 2026

(54) FENCE

(71) Applicant: Hung Chih Wu, Tainan City (TW)

(72) Inventor: Hung Chih Wu, Tainan City (TW)

( * ) Notice: Subject to any disclaimer, the term of this patent is extended or adjusted under 35 U.S.C. 154(b) by 207 days.

(21) Appl. No.: 18/407,047

(22) Filed: Jan. 8, 2024

(65) Prior Publication Data

US 2025/0223832 A1 Jul. 10, 2025

(51) Int. Cl.
*E04H 17/16* (2006.01)

(52) U.S. Cl.
CPC ..... *E04H 17/165* (2013.01)

(58) Field of Classification Search
CPC ..... A01G 9/28; A01G 13/20; A01G 13/26; A01G 13/262; A01G 13/264; E04H 17/006; E04H 17/066; E04H 17/16; E04H 17/1602; E04H 17/163; E04H 17/164; E04H 17/165; E04H 17/166; E04H 17/17; E04H 17/18; E04H 17/185; E04H 17/22; E04H 17/23; E04H 17/24; E04F 11/1857
USPC ..... 256/1, 31, 73; 40/606.01, 607.05, 40/607.06, 607.07, 611.09, 611.1
See application file for complete search history.

(56) References Cited

U.S. PATENT DOCUMENTS 2,078,221 A * 4/1937 Julian ..... G09F 7/00 40/606.01
2,515,818 A * 7/1950 Bennett ..... G09F 7/00 40/607.06
2,581,762 A * 1/1952 Hesse ..... G09F 15/0012 40/607.05
2,877,600 A * 3/1959 Slate ..... A01G 9/28 47/33
4,103,445 A * 8/1978 Smith ..... G09F 7/00 248/156
4,817,319 A * 4/1989 Vitale ..... E01F 9/658 40/610
4,899,991 A * 2/1990 Brunkan ..... E04H 17/1447 256/65.06
4,907,783 A * 3/1990 Fisk ..... E04H 17/06 47/33
5,328,156 A * 7/1994 Hoke ..... E04H 17/06 256/32

(Continued)

FOREIGN PATENT DOCUMENTS

GB 2561825 A * 10/2018 ..... E04H 17/14
WO WO-02080658 A1 * 10/2002 ..... A01G 9/28
WO WO-2015099007 A1 * 7/2015 ..... F16B 12/26

*Primary Examiner* — Amber R Anderson
*Assistant Examiner* — Kevin J Baynes
(74) *Attorney, Agent, or Firm* — Che-Yang Chen

(57) ABSTRACT

A fence includes a rectangular frame including a top, a bottom, two sides, and a plurality of pegs configured to drive into the ground for holding the fence to the ground; and a hollow folding member including a top element, a main element extending downward from the top element and having a bottom opening and a folding bottom panel, two side elements having a folding side panel extending laterally, and an internal space communicating with the bottom opening and configured to receive the frame. There is further provided with an interconnecting member including a plurality of units each having a pressing element on a top and a plug element extending downward from the pressing element, the plug element configured to fill the positioning hole.

8 Claims, 12 Drawing Sheets

(56) References Cited

U.S. PATENT DOCUMENTS 5,402,988 A * 4/1995 Eisele ..... E01F 13/022 256/73
5,520,477 A * 5/1996 Fink ..... F16B 5/0028 403/231
5,640,817 A * 6/1997 Bos ..... E01F 8/0017 52/270
5,671,913 A * 9/1997 Vesper ..... E04H 17/1602 52/309.7
5,927,694 A * 7/1999 Montepiano ..... E04H 17/143 256/22
6,085,458 A * 7/2000 Gau ..... A01G 9/28 47/33
6,561,491 B2 * 5/2003 Thompson ..... E04H 17/063 47/33
6,719,276 B1 * 4/2004 Bush ..... E04H 17/16 40/606.03
7,118,096 B2 * 10/2006 Petrozziello ..... E04H 17/066 256/33
7,240,637 B2 * 7/2007 Rosen ..... A01K 3/00 119/524
7,603,965 B1 * 10/2009 Betts ..... A01K 3/00 119/524
7,997,560 B2 * 8/2011 Bergdoll ..... E04H 17/066 256/67
8,308,141 B1 * 11/2012 Mellins ..... E04H 17/163 256/25
8,356,800 B2 * 1/2013 Robinson ..... A63B 71/022 256/73
9,168,446 B2 * 10/2015 Robinson ..... E04H 17/164
9,267,323 B2 * 2/2016 Whooley ..... E06B 9/02
10,024,077 B2 * 7/2018 Witherspoon ..... E04H 17/063
10,660,276 B1 * 5/2020 Harris ..... A01G 13/26
11,441,328 B2 * 9/2022 Swensson ..... E04H 17/16
11,741,858 B2 * 8/2023 Riggs ..... G09F 7/18 40/611.01
11,957,095 B2 * 4/2024 Fischer ..... A01G 9/28
12,338,649 B2 * 6/2025 Dunning-Gill ..... E04H 17/006
12,385,209 B2 * 8/2025 Cheek ..... E04H 17/22
2001/0045056 A1 * 11/2001 Hulett ..... A01G 9/28 47/33
2001/0048103 A1 * 12/2001 Painter ..... E04H 17/1413 256/65.01
2002/0121063 A1 * 9/2002 Mathias ..... E04B 2/7425 52/578
2003/0075712 A1 * 4/2003 Lin ..... E04H 17/017 256/1
2003/0230026 A1 * 12/2003 Dillon ..... E04H 12/2215 47/33
2004/0206947 A1 * 10/2004 Rosaen ..... E04H 12/2215 256/25
2006/0118772 A1 * 6/2006 Rosine ..... E04H 17/17 256/24
2013/0105754 A1 * 5/2013 Filippo ..... E04H 17/16 256/59
2015/0021532 A1 * 1/2015 Smith ..... E04H 17/05 256/65.01
2017/0081873 A1 * 3/2017 Crawford ..... E04H 17/165
2019/0106850 A1 * 4/2019 Fiordi ..... A01G 9/28
2019/0218816 A1 * 7/2019 Kumerz Gonzalez ..... E04H 17/165

* cited by examiner

FENCE

FIELD OF THE INVENTION

The invention relates to fences and more particularly to a fence having improved characteristics.

BACKGROUND OF THE INVENTION

House holders and professional fence builders would recognize that building of conventional fences is time consuming due to complex components. Further, flowerpots disposed in the conventional fence are not protected.

Thus, the need for improvement still exists.

SUMMARY OF THE INVENTION

It is therefore one object of the invention to provide a fence comprising a frame shaped as a rectangle and including a top, a bottom, two sides, and a plurality of pegs configured to drive into the ground for holding the fence to the ground; and a folding member being hollow and including a top element, a main element extending downward from the top element and having a bottom opening and a folding bottom panel, two side elements having a folding side panel extending laterally, and an internal space communicating with the bottom opening and configured to receive the frame.

Preferably, the top of the frame includes a plurality of positioning holes.

Preferably, a cross-section of the peg is a cross.

Preferably, a cross-section of the peg is a triangle.

Preferably, further comprises an interconnecting member including a plurality of units each having a pressing element on a top and a plug element extending downward from the pressing element, the plug element configured to fill the positioning hole.

Preferably, the top element of the folding member includes a plurality of holes aligned with the positioning holes respectively.

Preferably, further comprises a positioning member including a longitudinal groove and a holding portion extending laterally from the longitudinal groove.

Preferably, the longitudinal groove includes a plurality of ribs.

The above and other objects, features and advantages of the invention will become apparent from the following detailed description taken with the accompanying drawings

DETAILED DESCRIPTION OF THE INVENTION

Figure 1:
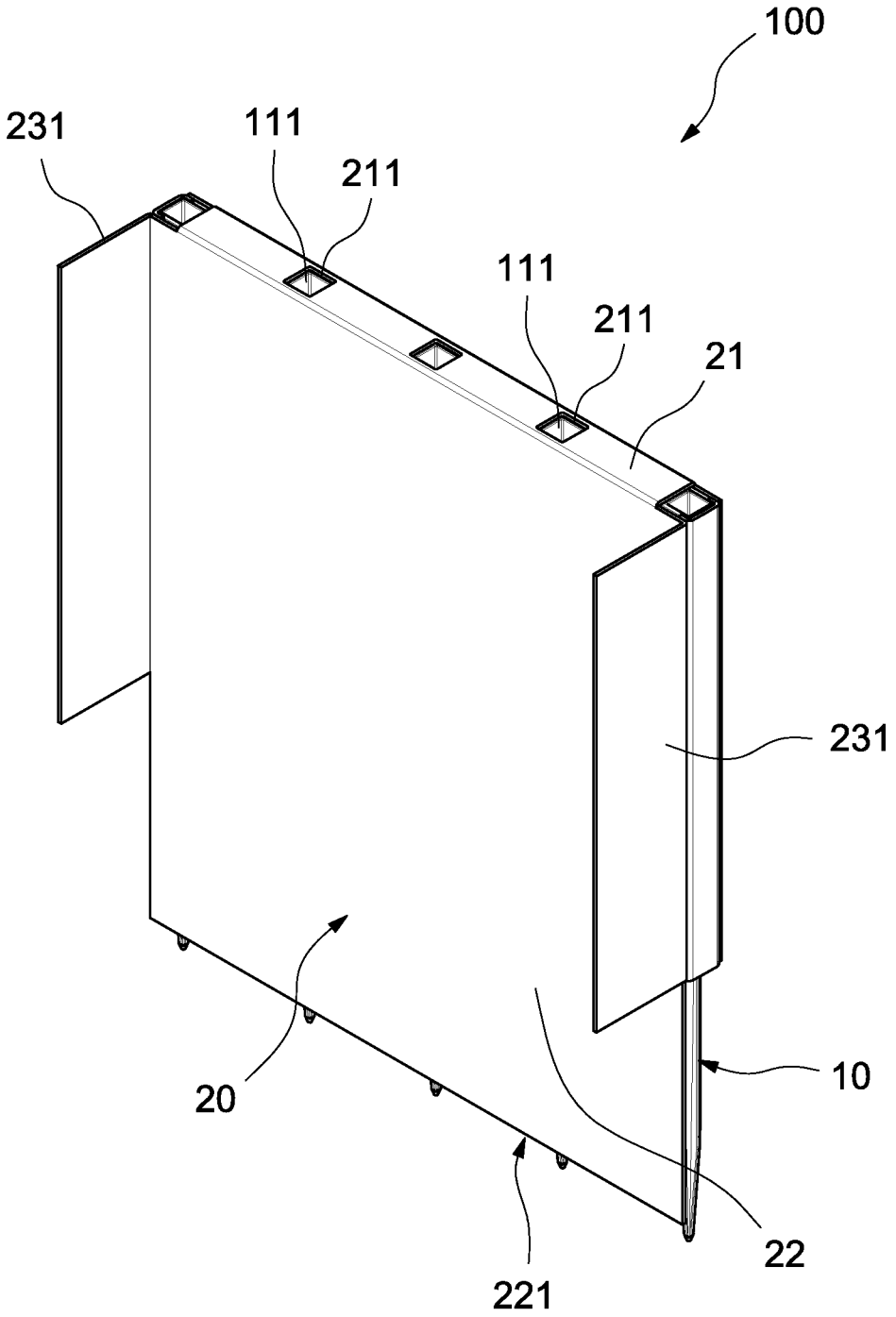
FIG. 1 is a perspective view of a fence according to a preferred embodiment of the invention.
Figure 2:
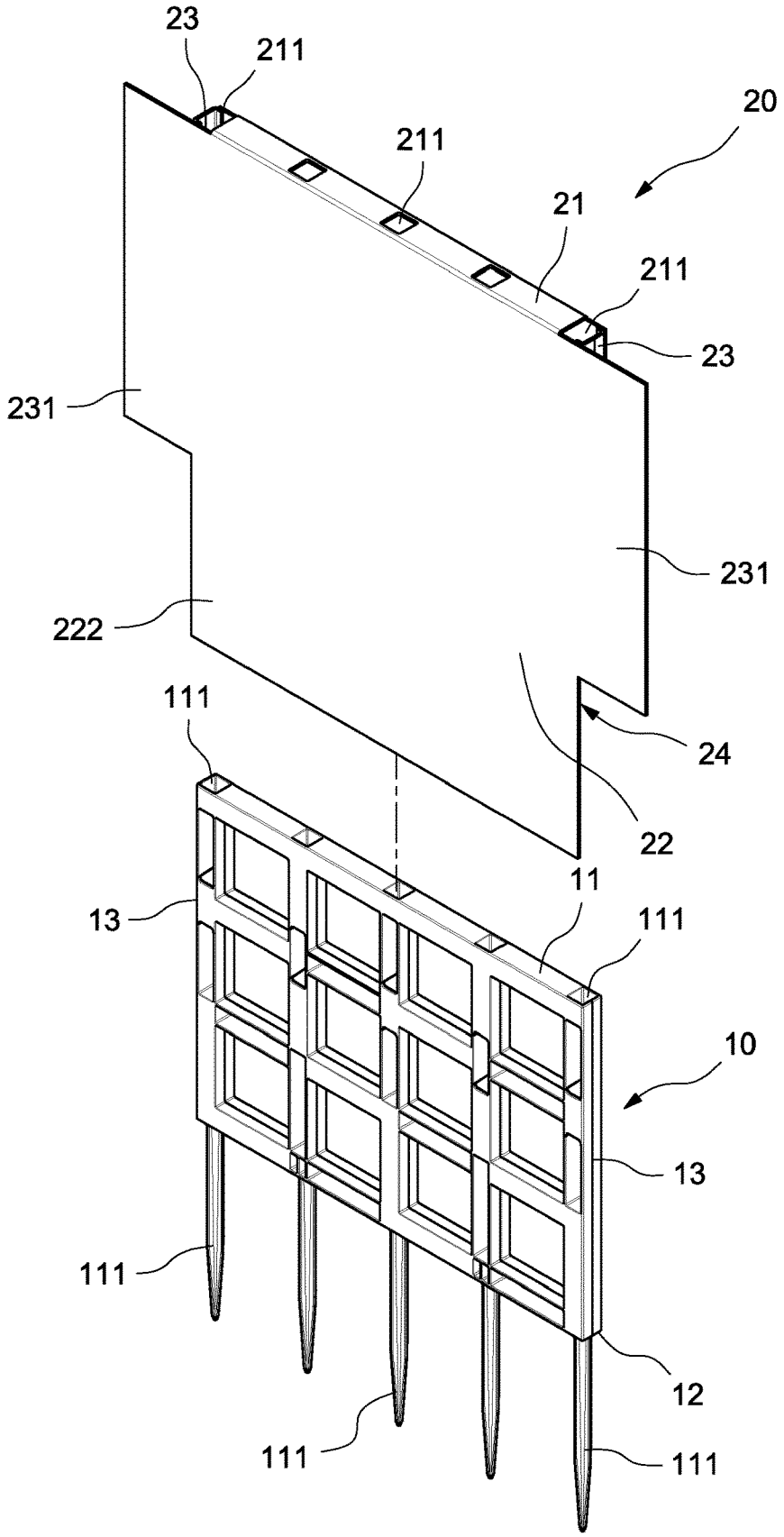
FIG. 2 is an exploded view of the fence with two side panels of two sides of a folding member being unfolded.
Figure 3:
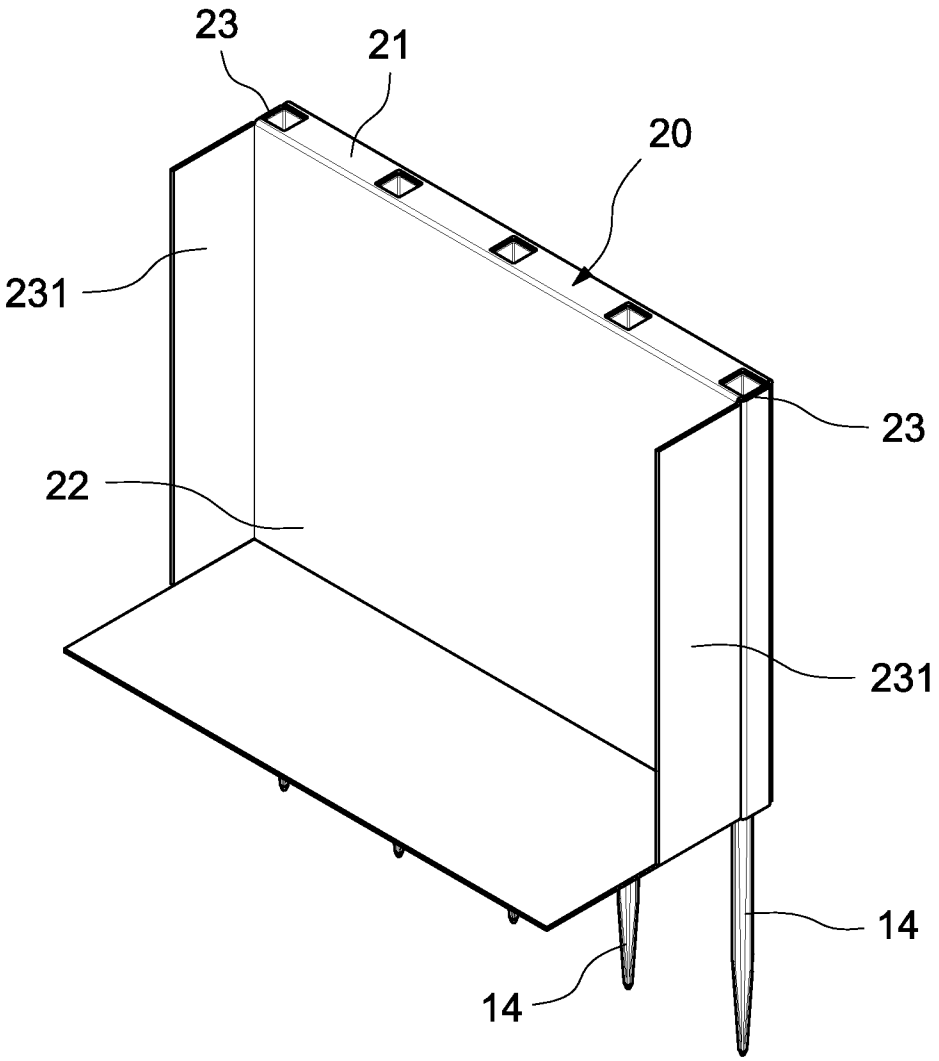
FIG. 3 is a view similar to FIG. 1 with a folding bottom panel of the folding member being folded.
Figure 6:
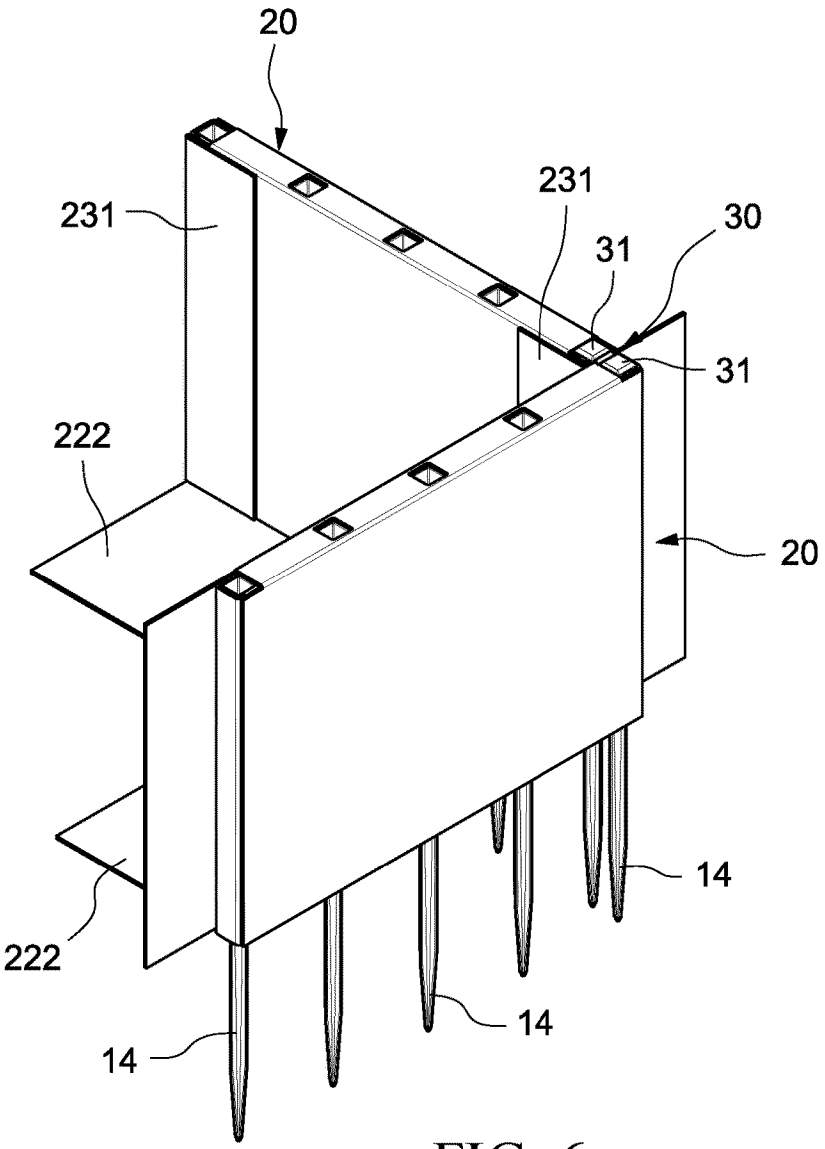
FIG. 6 is a perspective view showing the first and second fences being joined in which the first fence is at an angle of 90-degree with respect to the second fence.

Referring to FIGS. 1 and 6, a fence 100 according to a preferred embodiment of the invention comprises the following components as discussed in detail below.

A frame 10 is a rectangular structural framework and includes a top 11 having a plurality of positioning holes 111, a bottom 12, two sides 13, and a plurality of pegs 14 configured to drive into the ground for holding the fence 100 to the ground.

A folding member 20 is hollow and includes a top 21 having a plurality of holes 211 aligned with the positioning holes 111 respectively, a main element 22 extending downward from the top 21 and having an opening 221 open to the bottom and a folding bottom panel 222, two sides 23, and an internal space 24 communicating with the opening 221. The side 23 includes a folding side panel 231 extending laterally. The frame 10 is disposed in the internal space 24 by passing through the opening 221 from below. Thus, the frame 10 is protected.

Figure 4:
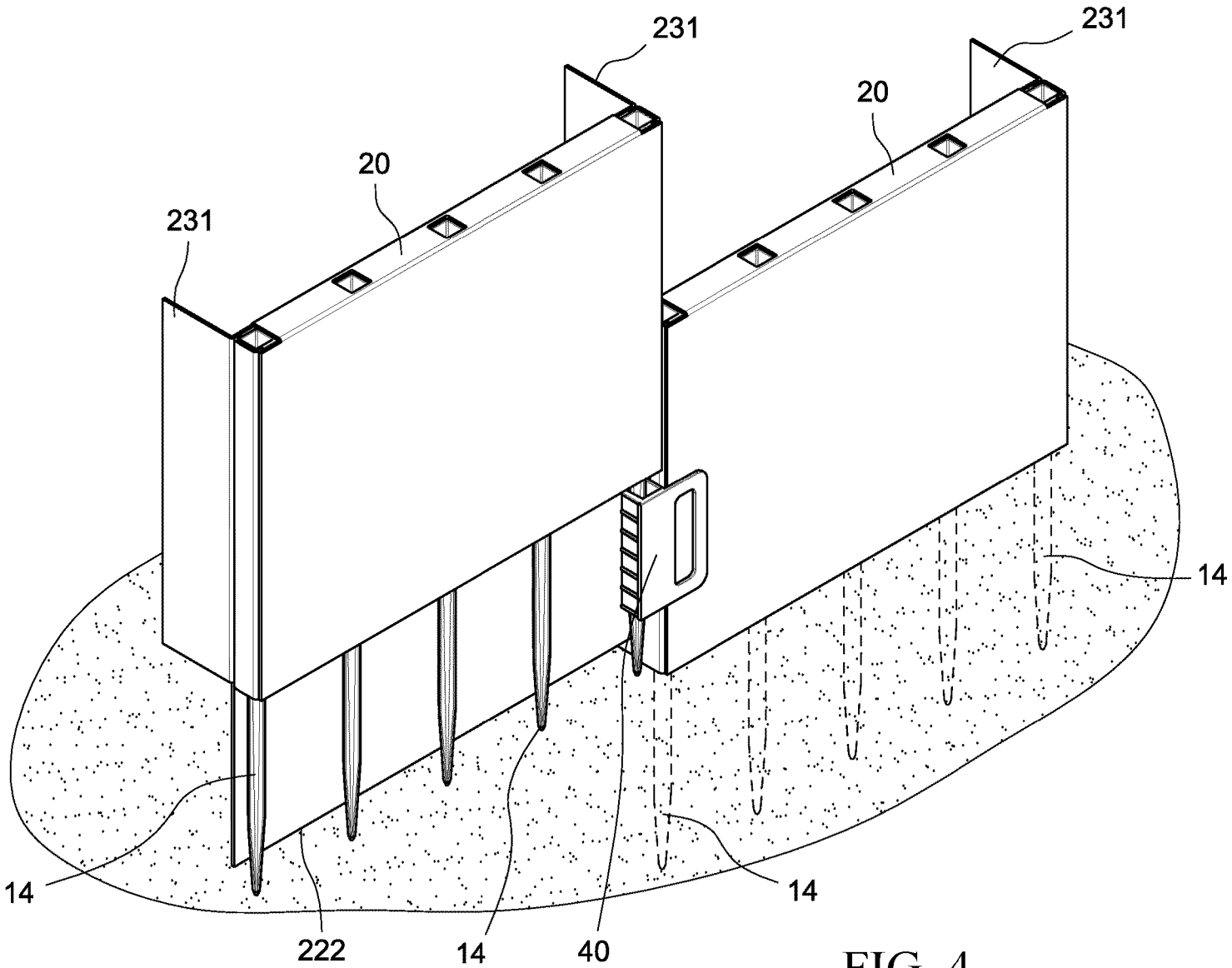
FIG. 4 schematically depicts a first fence been driven into the ground and a second fence positioned by a positioning member prior to driving into the ground to join the first fence side by side.
Figure 5:
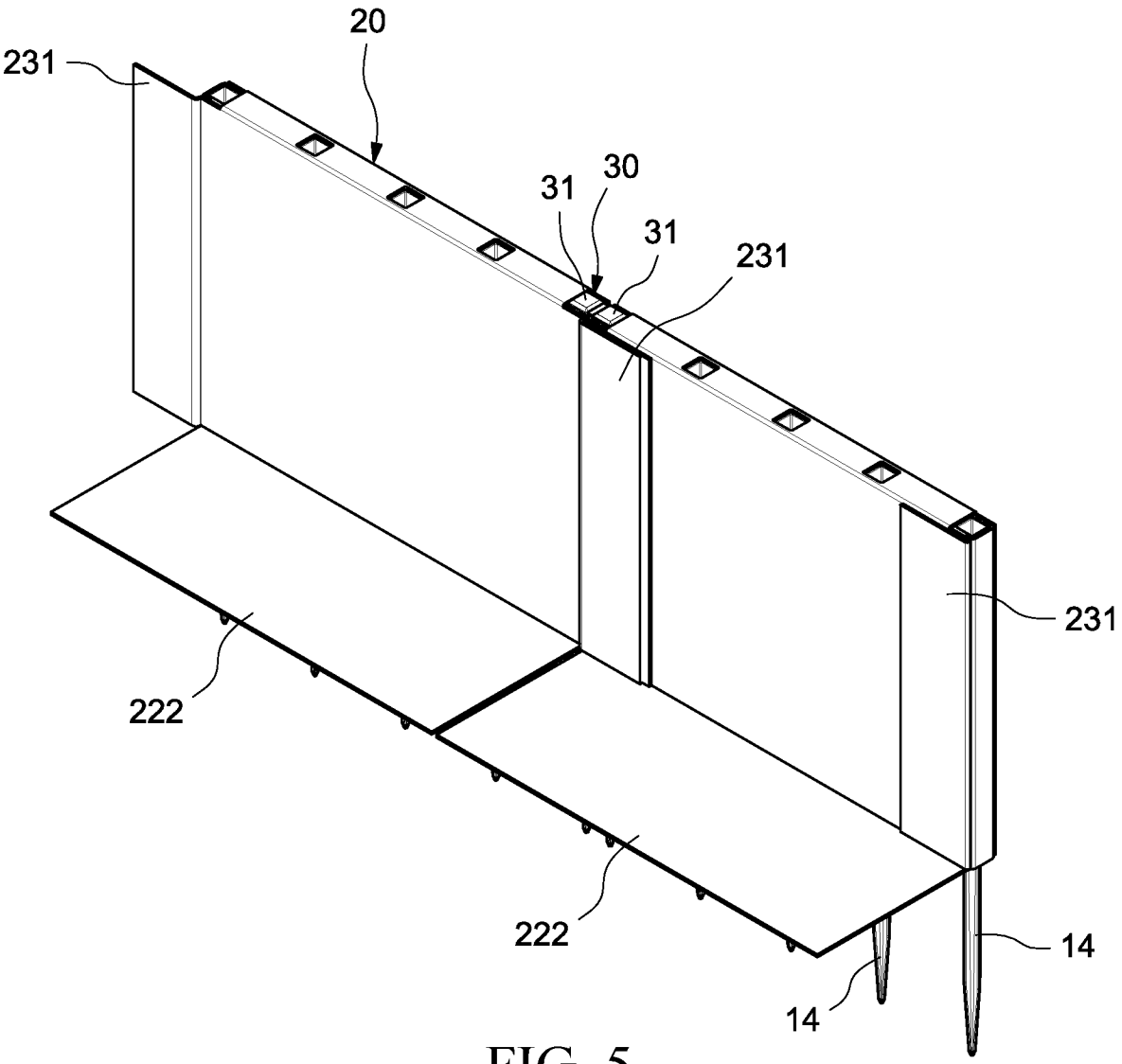
FIG. 5 is a perspective view showing the first and second fences being joined side by side.

A plurality of flowerpots (not shown) can be placed in the frame 10 to be cultivated. As shown in FIG. 4 specifically, a second fence 100 is positioned by a positioning member 40 prior to driving into the ground to join the first fence 100 side by side. As shown in FIG. 5 specifically, the first and second fences 100 are joined side by side by an interconnecting member 30. Alternatively, the first and second fences 100 are joined in which the first fence 100 is at an angle of 90-degree with respect to the second fence 100 (see FIG. 6). A cross-section of the pegs 14 is a cross for increasing the fastening of the fence 100 to the ground.

Figure 7:
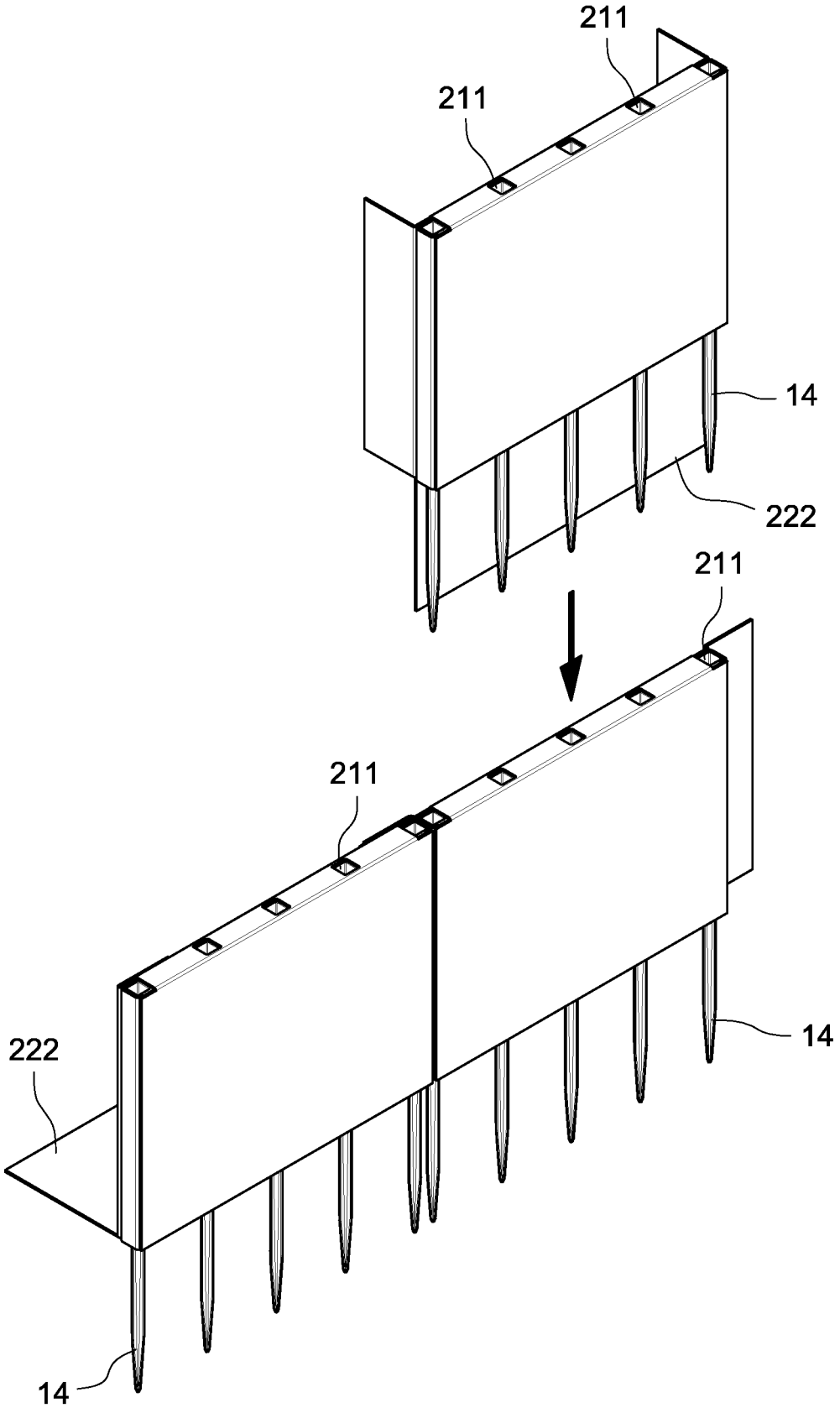
FIG. 7 schematically depicts two fences being joined side by side and a third fence to be secured to a top of the second fence.

Referring to FIG. 7, a third fence 100 can be secured to the second fence 100 by inserting the pegs 14 thereof through the holes 221 into the positioning holes 111 of the second fence 100. As a result, height of the fence is increased.

Figure 8:
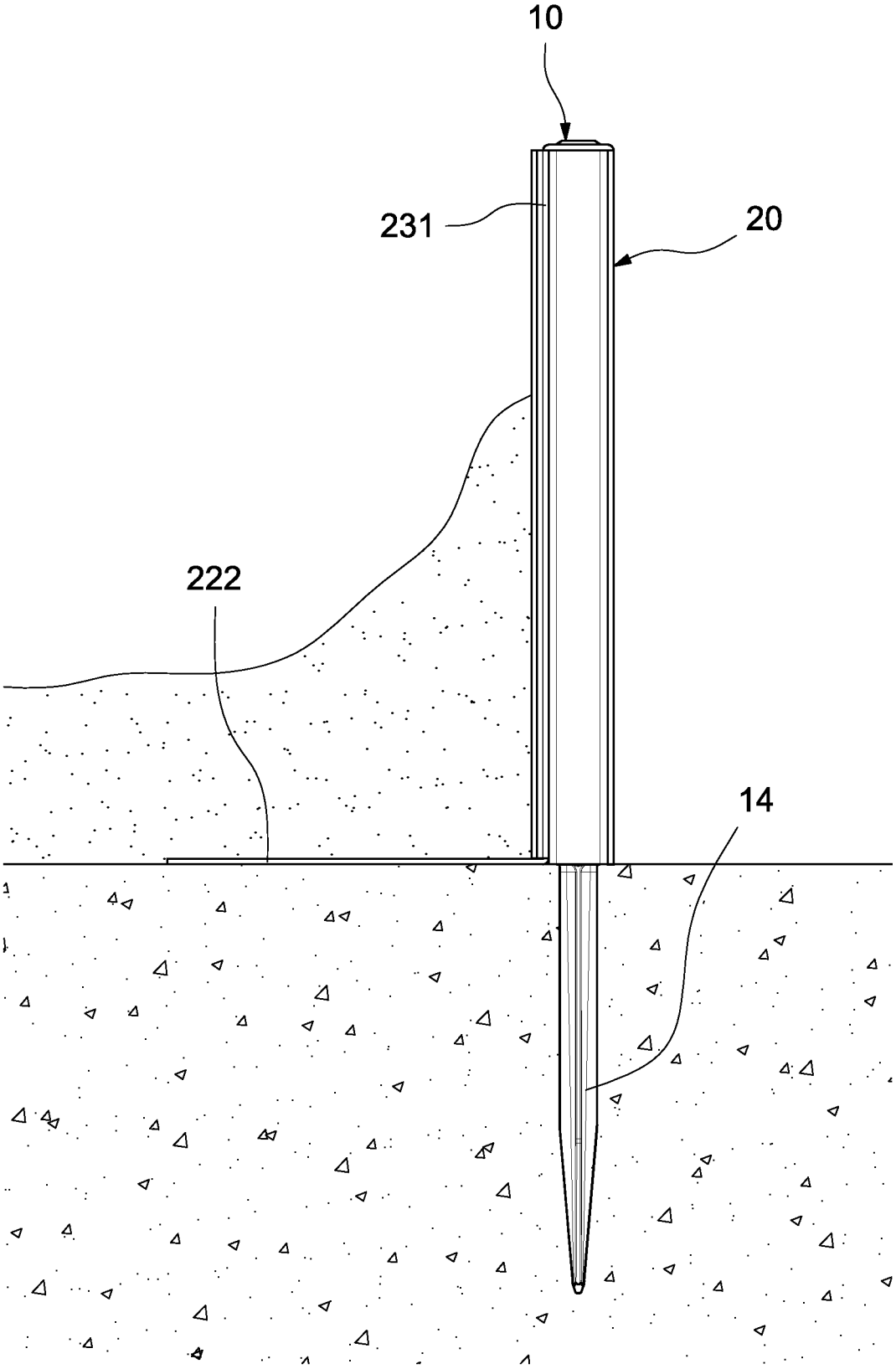
FIG. 8 is a side elevation schematically showing the pegs of the fence driven into the ground.

Referring to FIG. 8, the pegs 14 are driven into the ground for holding the fence 100 to the ground. The folding bottom panel 222 is folded to dispose at an angle of about 90-degree with respect to the main element 22.

Figure 9:
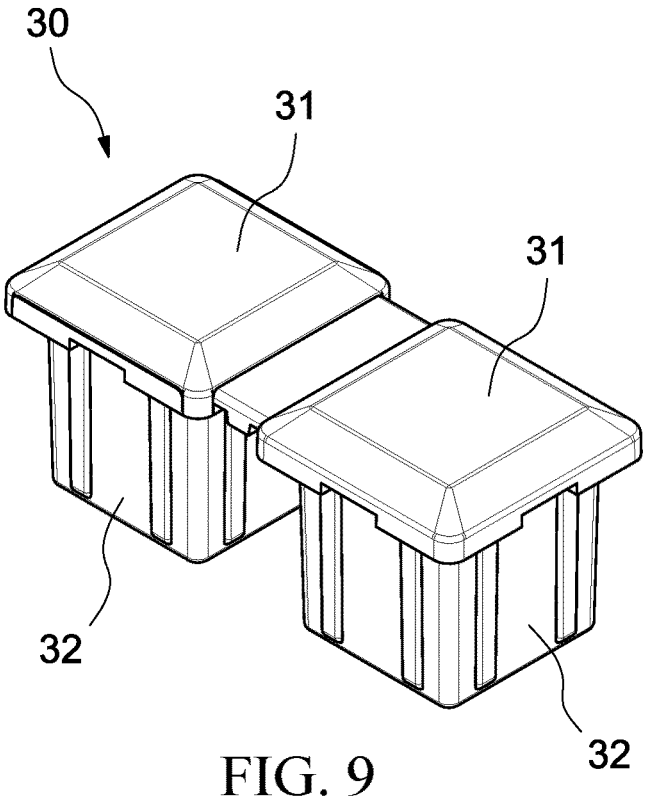
FIG. 9 is a perspective view of an interconnecting member.

Referring to FIG. 9, the interconnecting member 30 includes two units each having a pressing element 31 on a top and a plug element 32 extending downward from the pressing element 31 and configured to pass through the hole 211 to fill the positioning hole 111. As a result, the two fences 100 are secured together.

Figure 10:
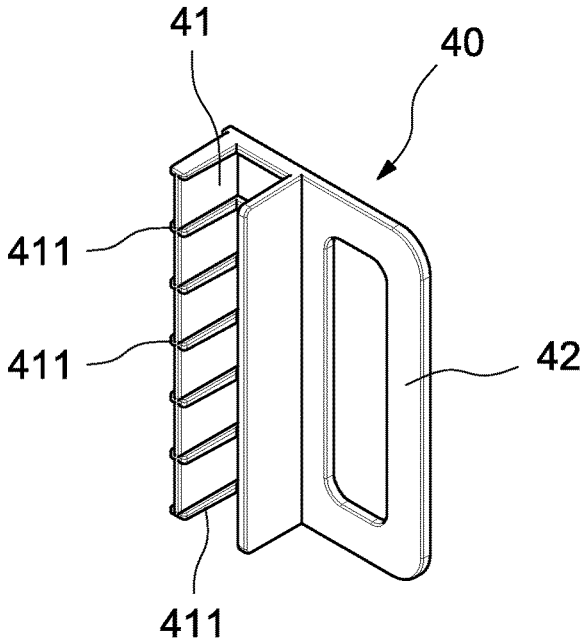
FIG. 10 is a perspective view of the positioning member.

Referring to FIG. 10, the positioning member 40 includes a longitudinal groove 41 having a plurality of ribs 411 for increasing friction with the peg 14 in the peg positioning step, and a holding portion 42 extending laterally from the longitudinal groove 41.

Figure 11:
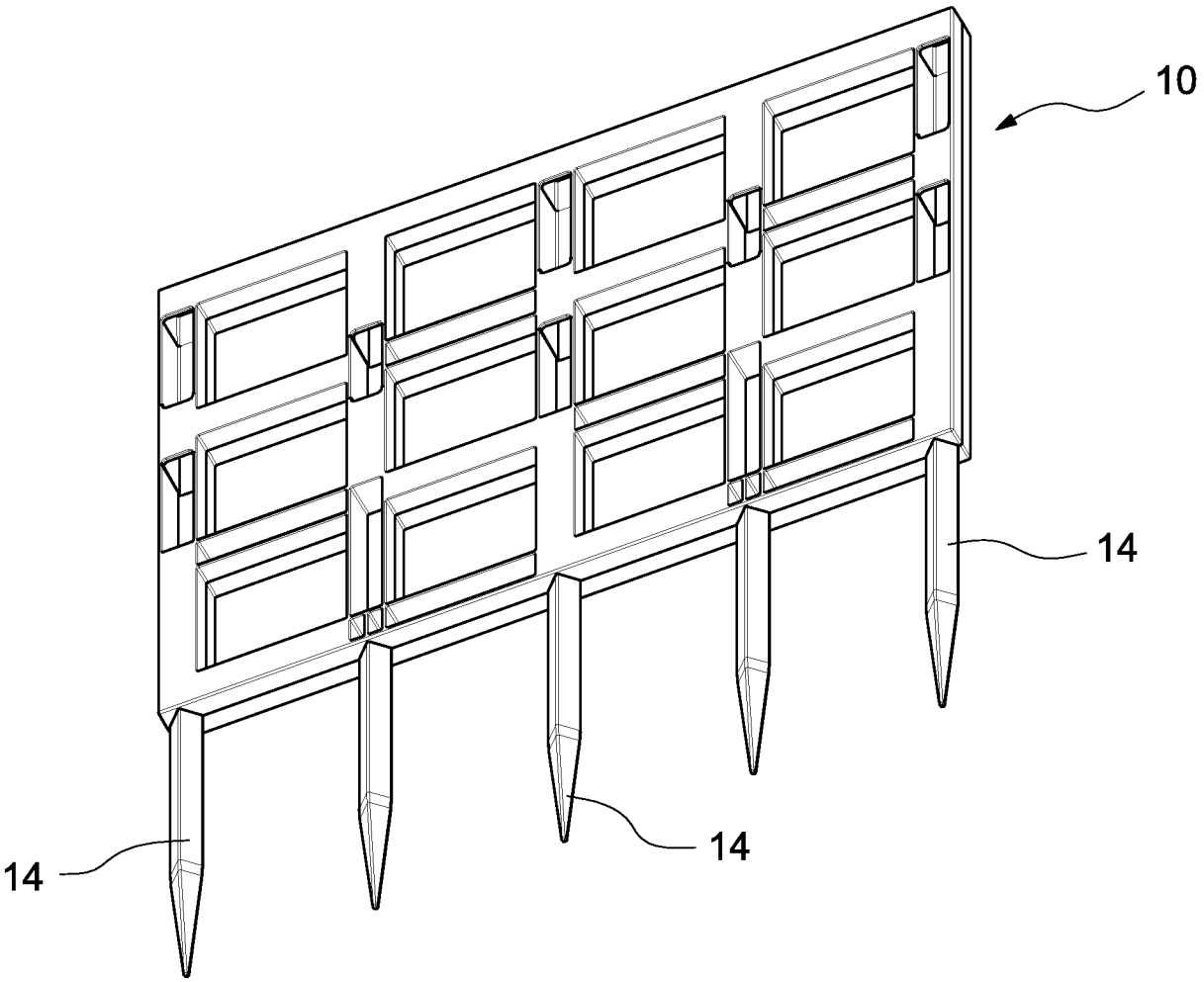
FIG. 11 is a perspective view of a frame according to another preferred embodiment of the invention.

Referring to FIG. 11, a cross-section of the peg 14 is a triangle. for increasing the fastening of the fence to the ground.

Figure 12:
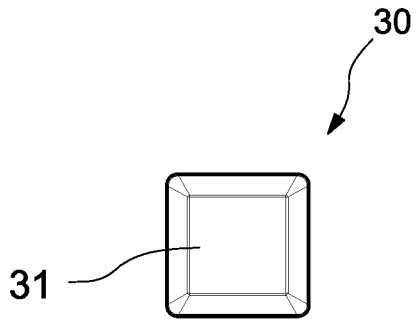
FIG. 12 is a top plan view of an interconnecting member according to a second preferred embodiment of the invention.
Figure 13:
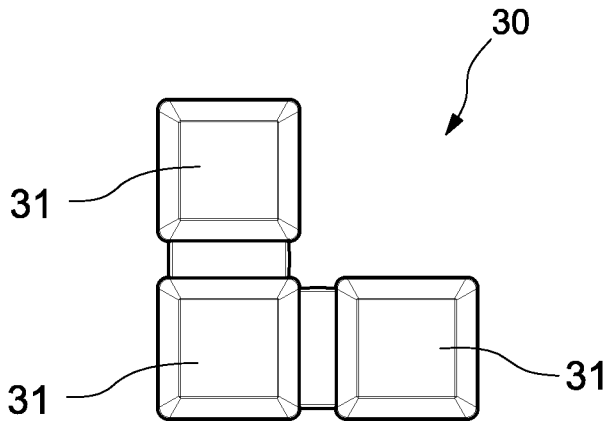
FIG. 13 is a top plan view of an interconnecting member according to a third preferred embodiment of the invention.
Figure 14:
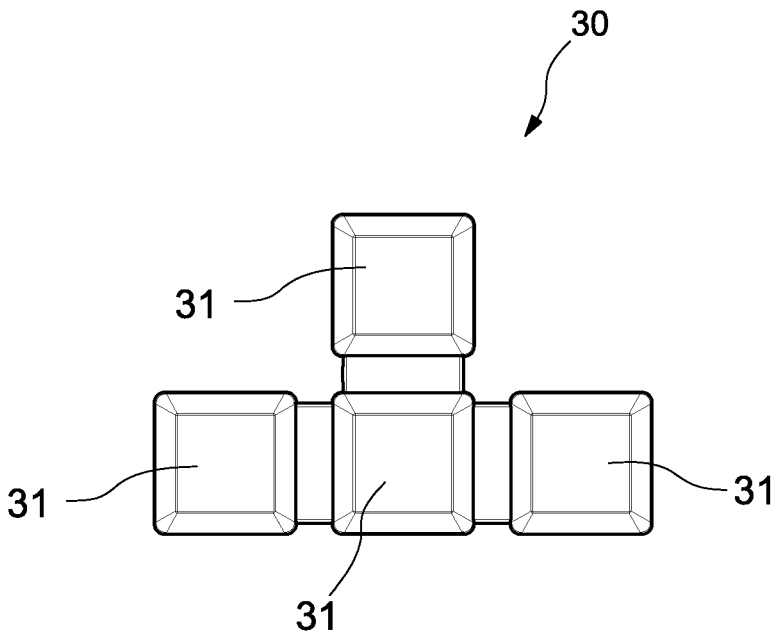
FIG. 14 is a top plan view of an interconnecting member according to a fourth preferred embodiment of the invention.
Figure 15:
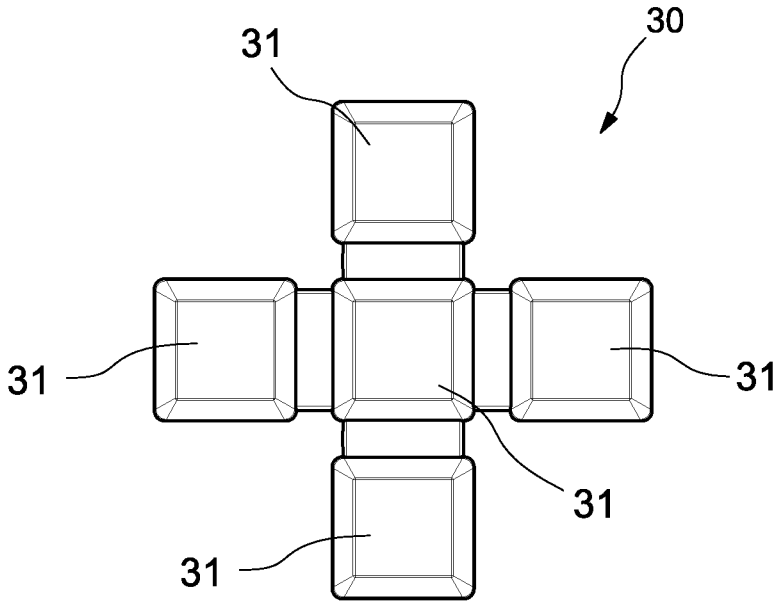
FIG. 15 is a top plan view of an interconnecting member according to a fifth preferred embodiment of the invention.

Referring to FIGS. 12 and 15, the interconnecting member 30 can be a single block (see FIG. 12), is shaped an L when viewing from a top (see FIG. 13), is shaped as an inverted T when viewing from a top (see FIG. 14), or is shaped as a cross when viewing from a top (see FIG. 15).

While the invention has been described in terms of preferred embodiments, those skilled in the art will recognize that the invention can be practiced with modifications within the spirit and scope of the appended claims.

What is claimed is:

1. A fence, comprising:

a frame shaped as a rectangle and including a top, a bottom, two sides, and a plurality of pegs configured to drive into the ground for holding the fence to the ground; and a folding member being hollow and including a top element, a main element extending downward from the top element and having a bottom opening and a folding bottom panel, two side elements each having a folding side panel extending laterally, and an internal space communicating with the bottom opening and configured to receive the frame, wherein the folding bottom panel is configured to be folded relative to the main element when the pegs are driven into the ground.

2. The fence of claim 1, wherein the top of the frame includes a plurality of positioning holes.

3. The fence of claim 2, further comprising an interconnecting member including a plurality of units each having a pressing element on a top and a plug element extending downward from the pressing element, the plug elements configured to fill the positioning holes.

4. The fence of claim 2, wherein the top element of the folding member includes a plurality of holes aligned with the positioning holes respectively.

5. The fence of claim 1, wherein a cross-section of each of the pegs is a cross.

6. The fence of claim 1, wherein a cross-section of each of the pegs is a triangle.

7. The fence of claim 1, further comprising a positioning member including a longitudinal groove and a holding portion extending laterally from the longitudinal groove, wherein the positioning member is configured to connect a second fence to the fence.

8. The fence of claim 7, wherein the longitudinal groove includes a plurality of ribs.

* * * * *